US010663155B2

(12) United States Patent
Torsanko et al.

(10) Patent No.: US 10,663,155 B2
(45) Date of Patent: May 26, 2020

(54) LIGHT DISPLAY SYSTEM AND METHOD

(71) Applicants: Grace Torsanko, Green Cove Springs, FL (US); Paul Torsanko, Green Cove Springs, FL (US)

(72) Inventors: Grace Torsanko, Green Cove Springs, FL (US); Paul Torsanko, Green Cove Springs, FL (US)

( * ) Notice: Subject to any disclaimer, the term of this patent is extended or adjusted under 35 U.S.C. 154(b) by 0 days.

(21) Appl. No.: 16/352,689

(22) Filed: Mar. 13, 2019

(65) Prior Publication Data

US 2019/0285260 A1 Sep. 19, 2019

Related U.S. Application Data

(60) Provisional application No. 62/642,255, filed on Mar. 13, 2018.

(51) Int. Cl.

| | |
|---|---|
| ***F21V 23/04*** | (2006.01) |
| ***F21V 23/00*** | (2015.01) |
| ***F21V 21/08*** | (2006.01) |
| *F21V 31/00* | (2006.01) |
| *F21W 121/00* | (2006.01) |
| *F21Y 115/10* | (2016.01) |

(52) U.S. Cl.

CPC ..... *F21V 23/0435* (2013.01); *F21V 21/0816* (2013.01); *F21V 23/003* (2013.01); *F21V 31/005* (2013.01); *F21W 2121/00* (2013.01); *F21Y 2115/10* (2016.08)

(58) Field of Classification Search

CPC ..... F21V 23/0435; F21V 23/003; F21V 21/0816; F21V 31/005; F21Y 2115/10; F21W 2121/00

See application file for complete search history.

(56) References Cited

U.S. PATENT DOCUMENTS

| | | | | |
|---|---|---|---|---|
| 6,851,208 | B2 | 2/2005 | Carter | |
| 7,212,932 | B1 | 5/2007 | Taylor | |
| 7,812,547 | B2 | 10/2010 | Jaan | |
| 2010/0202139 | A1* | 8/2010 | Lynn | F21S 10/02 362/231 |
| 2011/0043241 | A1 | 2/2011 | Padula et al. | |
| 2011/0109236 | A1 | 5/2011 | Zhurin et al. | |
| 2011/0286205 | A1 | 11/2011 | Redpath et al. | |
| 2015/0345765 | A1* | 12/2015 | Horst | F21V 31/005 362/362 |

* cited by examiner

*Primary Examiner* — Kevin Quarterman
(74) *Attorney, Agent, or Firm* — Charles Runyan

(57) ABSTRACT

An ornamental light display system; the ornamental light display system includes at least one light device configured to provide periodic illumination simulating that of an insect utilizing bioluminescence (i.e., firefly). The light device(s) can be attached to branches within shrubbery, tree trunks, lower branches of trees, and other such areas in order to mimic how fireflies behave. The ornamental light display system is useful for providing ornamental lighting for decorating areas such that they appear to have fireflies.

20 Claims, 5 Drawing Sheets

LIGHT DISPLAY SYSTEM AND METHOD

CROSS-REFERENCE TO RELATED APPLICATION(S)

The present application is related to and claims priority to U.S. Provisional Patent Application No. 62/642,255 filed 13 Mar. 2018, which is incorporated by reference herein in its entirety.

BACKGROUND OF THE INVENTION

The following includes information that may be useful in understanding the present disclosure. It is not an admission that any of the information provided herein is prior art nor material to the presently described or claimed inventions, nor that any publication or document that is specifically or implicitly referenced is prior art.

TECHNICAL FIELD

The present invention relates generally to the field of ornamental lighting of existing art and more specifically relates to illuminated devices simulating an insect utilizing bioluminescence.

RELATED ART

The Lampyridae are a family of insects with many described species. They are soft-bodied beetles that are commonly called fireflies or lightning bugs for their conspicuous use of bioluminescence during twilight to attract mates or prey. Generally, fireflies can be found in temperate, tropical climates or in marshes and wet wooded areas. Individuals may enjoy viewing fireflies during lowlight hours of the day; however, some locations may be uninhabitable for fireflies. Further, municipal agencies spraying for mosquitoes have killed off natural aspects of the environment in populated areas. People living in these locations may end up disappointed if the view of the natural phenomenon of fireflies illuminating a yard or garden is unavailable. Therefore, a suitable solution is desired.

U.S. Pub. No. 2011/0109236 to Viacheslav Vasilievich Zhurin et al. relates to a periodic lighting device. The described periodic lighting device includes a detailed electronic method for simulation of a firefly, other insects, or organisms producing bioluminescence and with light radiation functions similar to a real firefly, other insects, or organisms producing bioluminescence. An illuminated artificial firefly, other insects, or organisms producing bioluminescence can be placed on trees and shrubs in landscape, or at home to produce radiation, at night time, and blinking a gradually decaying light. More particularly it relates to a decorative type of device in the form of a firefly, other insects, or organisms producing bioluminescence and with light radiation functions similar to a real firefly, other insects, or organisms producing bioluminescence. The light is simulated by an electronics program that is a part of compact device with the form of a real firefly, other insects, or organisms producing bioluminescence. Short radiation pulses of microsecond-millisecond duration time in violet and ultraviolet range of radiation wavelengths can be utilized for scaring birds or other animals from undesirable or dangerous places of human activity, such as airports, contaminated ponds, wind turbines, electricized fences and antennas.

SUMMARY OF THE INVENTION

In view of the foregoing disadvantages inherent in the known lighting art, the present disclosure provides a novel functional and ornamental light display system and method. The general purpose of the present disclosure, which will be described subsequently in greater detail, is to provide a functional ornamental light display system for simulating an insect utilizing bioluminescence.

An ornamental light display system is disclosed herein. The ornamental light display system is functional (having utility in nature) and includes at least one light device configured to provide periodic illumination simulating that of an insect utilizing bioluminescence. Each light device includes a housing containing a light emitting diode, a power supply for activating and energizing the light emitting diode, a control circuit electrically connected to the power supply, and a control unit adapted to send control signals to the control circuit. The control circuit may be configured to carry current to the power supply for turning the light emitting diode on or off periodically according to a preset timed interval stored on the control unit. The light devices are configured to operate independently of each other from their respective control units.

The ornamental light display system further includes a remote control in wireless commination with the control unit of each light device. The control circuit may be configured to carry current to the power supply for turning the light emitting diode on or off periodically according to one or more commands received from the remote control.

According to another embodiment, a method of using an ornamental light display system is also disclosed herein. The method includes providing an ornamental light display system including at least one light device configured to provide periodic illumination simulating that of an insect utilizing bioluminescence, each light device including a housing containing a light emitting diode, a power supply for activating and energizing the light emitting diode, a control circuit electrically connected to the power supply, and a control unit adapted to send control signals to the control circuit, programming the control unit with a preset timed interval for sending control signals to the control circuit, and illuminating the light emitting diode according to the preset timed interval.

For purposes of summarizing the invention, certain aspects, advantages, and novel features of the invention have been described herein. It is to be understood that not necessarily all such advantages may be achieved in accordance with any one particular embodiment of the invention. Thus, the invention may be embodied or carried out in a manner that achieves or optimizes one advantage or group of advantages as taught herein without necessarily achieving other advantages as may be taught or suggested herein. The features of the invention which are believed to be novel are particularly pointed out and distinctly claimed in the concluding portion of the specification. These and other features, aspects, and advantages of the present invention will become better understood with reference to the following drawings and detailed description.

BRIEF DESCRIPTION OF THE DRAWINGS

The figures which accompany the written portion of this specification illustrate embodiments and methods of use for the present disclosure, an ornamental light display system and method, constructed and operative according to the teachings of the present disclosure.

The various embodiments of the present invention will hereinafter be described in conjunction with the appended drawings, wherein like designations denote like elements.

DETAILED DESCRIPTION

As discussed above, embodiments of the present disclosure relate to an ornamental lighting and more particularly to a functional ornamental light display system and method as used to provide ornamental lighting simulating that of an insect utilizing bioluminescence.

Generally, the present invention provides users with lawn or garden ornaments designed to illuminate similarly to a firefly. It utilizes specially designed lighting devices in plastic housing for protection from inclement weather, animals, and the like. The device allows each unit to illuminate at preset intervals in which one unit illuminates every two to three seconds, a second unit illuminates every five to seven seconds, and so on. The present invention mimics the natural phenomenon of the firefly natural lighting means and preferably features a remote control which offers wireless activation and deactivation. Further, each device may include a zip tie or strap, allowing users to install the lights inside shrubbery, on tree branches, and hedging.

Referring now more specifically to the drawings by numerals of reference, there is shown in FIGS. 1-4, various views of an ornamental light display system 100 which is functional in nature to provide utility.

Figure 1:
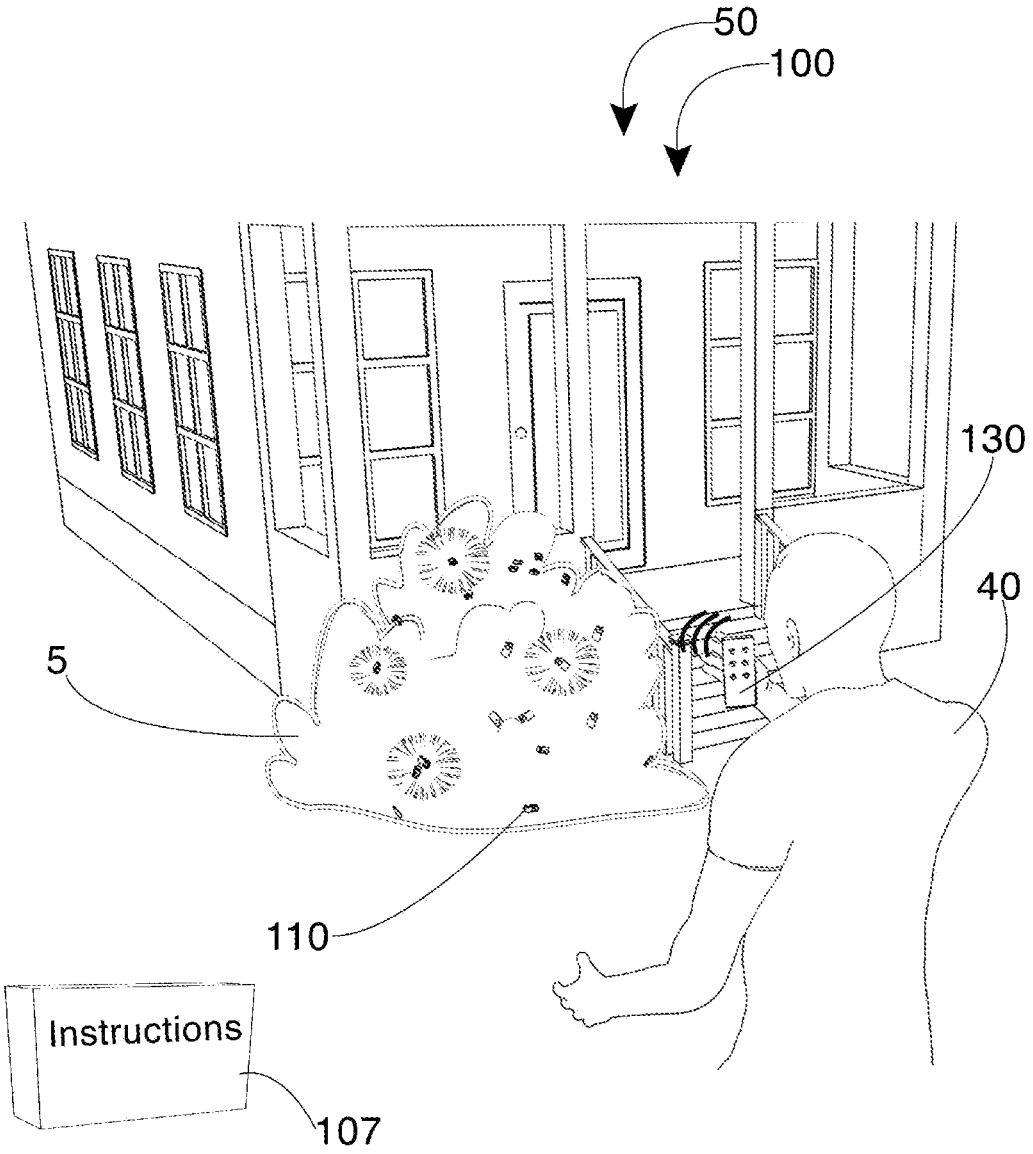
FIG. 1 is a perspective view of the ornamental light display system during an 'in-use' condition, according to an embodiment of the disclosure.
Figure 3:
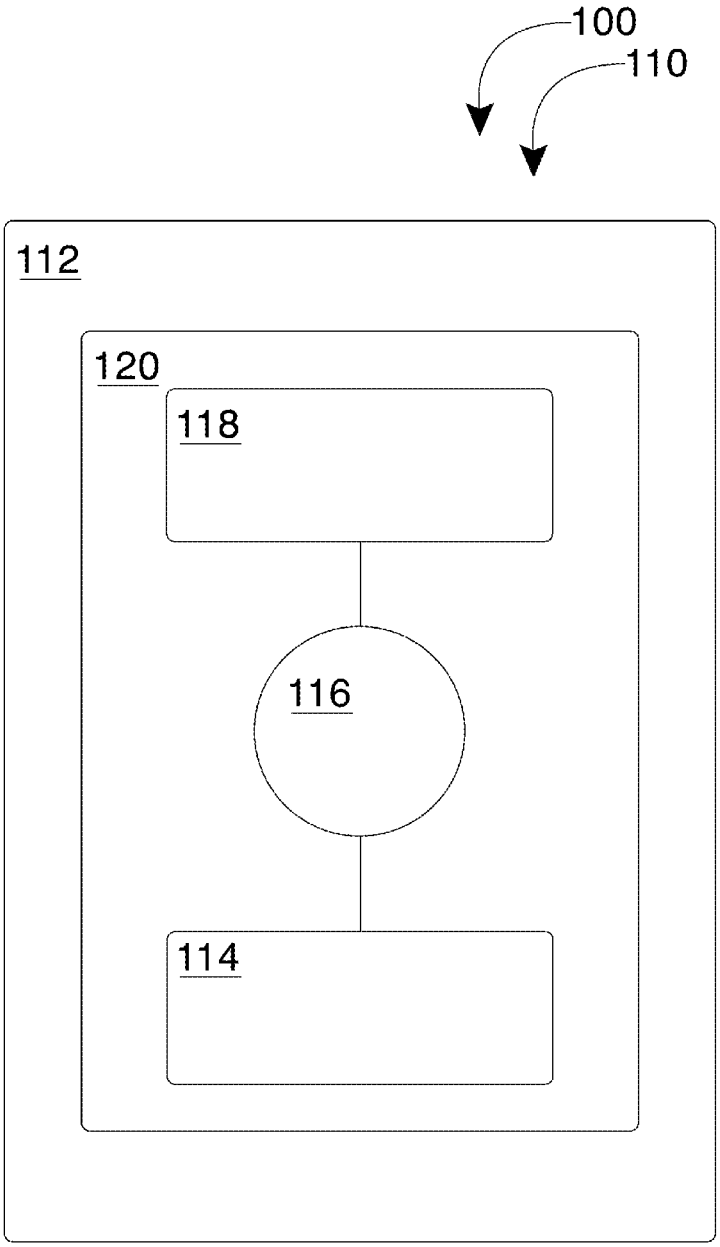
FIG. 3 is a block diagram of the ornamental light display system of FIG. 1, according to an embodiment of the present disclosure.

FIG. 1 shows an ornamental light display system 100 during an 'in-use' condition 50, according to an embodiment of the present disclosure. Here, the ornamental light display system 100 may be beneficial for use by a user 40 to attach a lighting display to one or more external objects 5 to simulate insects utilizing bioluminescence (i.e., firefly). As illustrated, the ornamental light display system 100 may include at least one light device 110 configured to provide periodic illumination simulating that of an insect utilizing bioluminescence. Each light device 110 may include a housing 112 containing a light emitting diode 114, a power supply 116 for activating and energizing the light emitting diode 114, a control circuit 118 electrically connected to the power supply 116, and a control unit 120 adapted to send control signals to the control circuit 118 (as shown in FIG. 3). The control circuit 118 may be configured to carry current to the power supply 116 for turning the light emitting diode 114 on or off periodically according to a preset timed interval stored on the control unit 120. The light devices 110 may be configured to operate independently of each other from their respective control units 120.

Another aspect of the present invention may provide for a remote control 130 in wireless commination with the control unit 120 of each light device 110. The control circuit 118 may be configured to carry current to the power supply 116 for turning the light emitting diode 114 on or off periodically according to one or more commands received from the remote control 130. At least one command from the remote control 130 includes collectively turning the light device(s) 110 on and alternately off. The control unit 120 may include a wireless communication module (not shown) for receiving command signals from the remote control 130. Those with ordinary skill in the art will now appreciate that upon reading this specification and by their understanding the art of wireless communication means as described herein, methods of wirelessly communicating with the control unit 120 from the remote control 130 will be understood by those knowledgeable in such art. The wireless communication module may conform to a plurality of wireless communication standards or protocols, including but not limited to WI-FI, BLUETOOTH, and/or include a transmitter and a receiver. Signaling means that are appropriately timed for mimicking are also know in the art.

According to one embodiment, the ornamental light display system 100 may be arranged as a kit 105. In particular, the ornamental light display system 100 may further include a set of instructions 107. The instructions 107 may detail functional relationships in relation to the structure of the ornamental light display system 100 such that the ornamental light display system 100 can be used, maintained, or the like, in a preferred manner.

Figure 2:
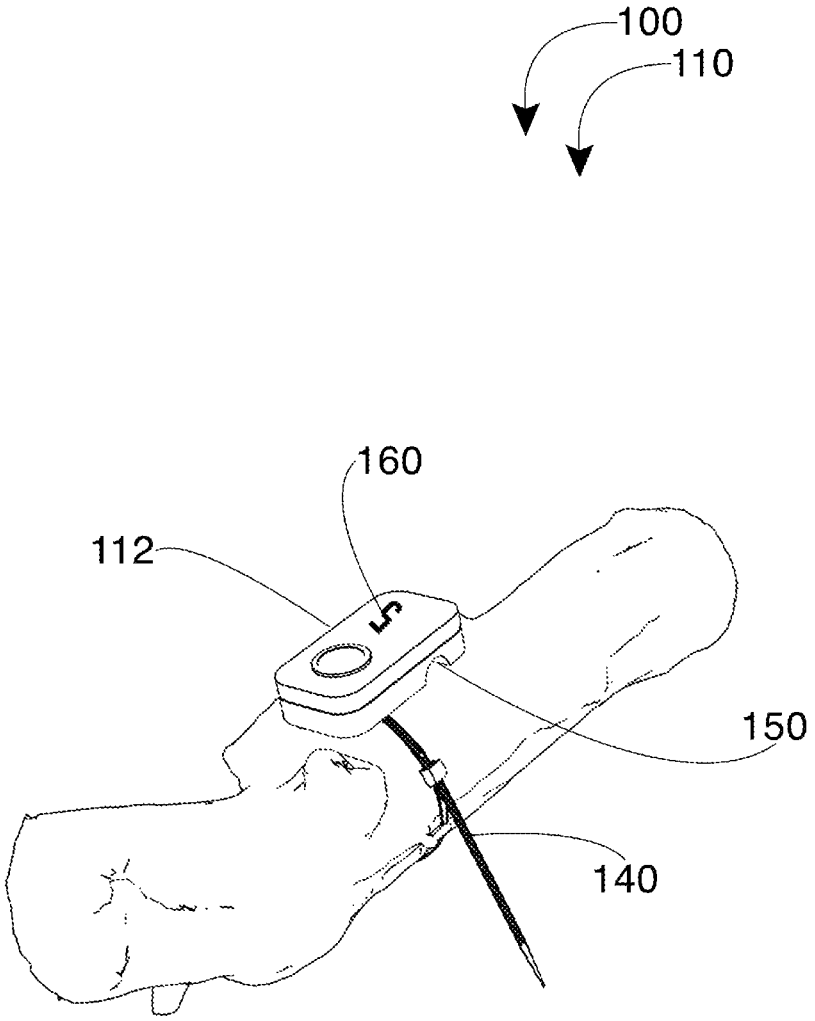
FIG. 2 is a perspective view of the ornamental light display system of FIG. 1, according to an embodiment of the present disclosure.

FIG. 2 shows the ornamental light display system 100 of FIG. 1, according to an embodiment of the present disclosure. The ornamental light display system 100 may further include a mounting member 140 for securing the light device(s) 110 on and around an external object (e.g., branch, shrubbery, pole, etc.). As shown, the mounting member 140 includes a zip tie. Alternatively, the mounting member 140 can include a strap. In one embodiment, the mounting member 140 may be removably attached to the housing 112 by a fastener or the like. This may be desired if the mounting member 140 is not reusable, such as with the zip tie. In an alternative embodiment, the mounting member 140 may be permanently attached to the housing 112. This may be desired if the mounting member 140 is reusable, such as with the strap.

Further, the housing 112 may have functional-indicia 160 embossed thereon. The functional-indicia 160 includes the preset timed interval for the respective light device 110. The preset timed interval may be in units of seconds (e.g., 3 seconds, 5 seconds, etc.). Seconds are used herein as to most closely mimic the way the firefly illuminates. Outside of the functional-indicia 160, the housing 112 may be substantially transparent. The housing 112 may also include a weather-tight seal that that water and dust to do not harm the interior components of the light device 110.

FIG. 3 is a block diagram of the ornamental light display system 100 of FIG. 1, according to an embodiment of the present disclosure. As above, the ornamental light display system 100 may include the light device(s) 110 configured to provide periodic illumination simulating that of an insect utilizing bioluminescence. Each light device 110 may include the housing 112 containing the light emitting diode 114, the power supply 116 for activating and energizing the light emitting diode 114, the control circuit 118 electrically connected to the power supply 116, and the control unit 120 adapted to send control signals to the control circuit 118. The power supply 116 may be a replaceable single cell battery. The control circuit 118 may be configured to carry current to the power supply 116 for turning the light emitting diode 114 on or off periodically according to the preset timed interval stored on the control unit 120. The light emitting diode 114 may gradually illuminate approximately half the length of the housing 112 when activated to mimic the way the firefly illuminates when moving or flying.

In some embodiments, the light device 110 may be turned on and alternatively off by a button or switch coupled to the housing 112 and the control unit 120. This may be combined with the remote control 130 or be an alternative way for turning the light devices 110 on/off.

Figure 4:
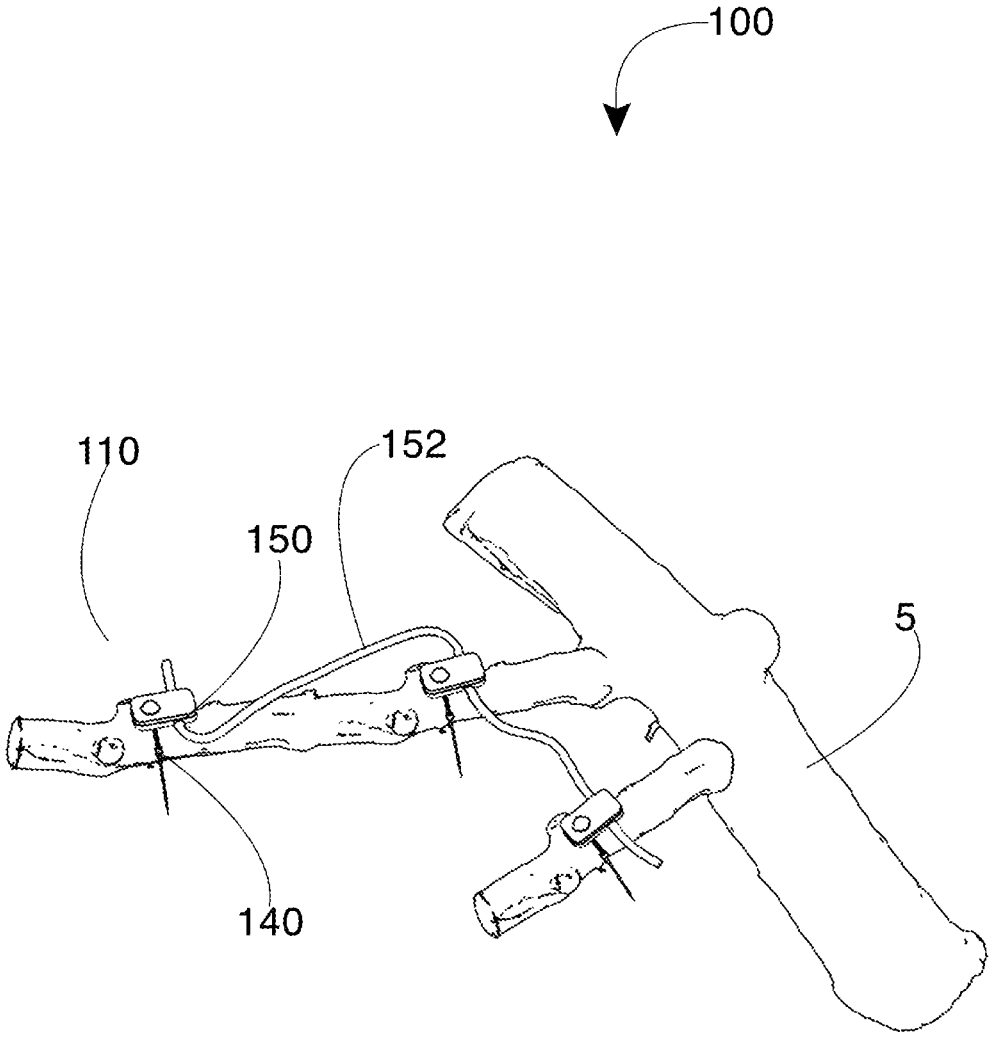
FIG. 4 is a perspective view of the ornamental light display system of FIG. 1, according to an embodiment of the present disclosure.

FIG. 4 is a perspective view of the ornamental light display system 100 of FIG. 1, according to an embodiment of the present disclosure. As illustrated, the housing 112 may include a channel 150. The channel 150 may be configured to receive a cord 152 or other similar item (e.g. rope). The cord 152 interconnects two or more light devices 110 together along a length of the cord 152. The cord 152 may be used to distinguish the light devices 110 on the external object 5 such that it is easier for the user 40 to find them.

Figure 5:
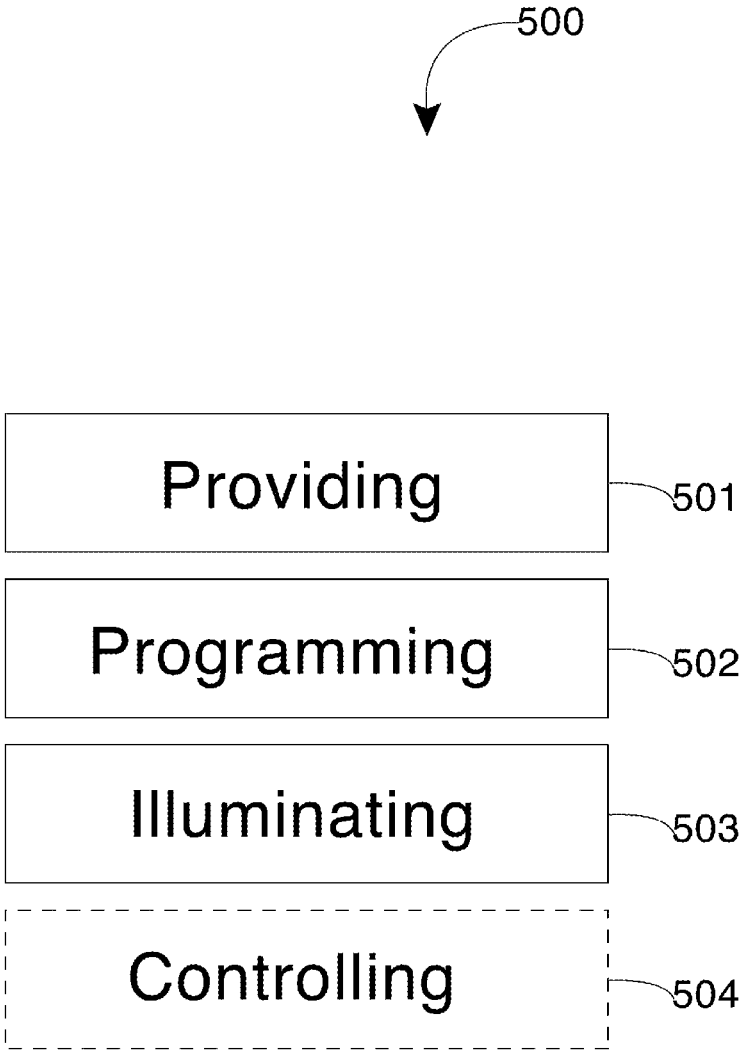
FIG. 5 is a flow diagram illustrating a method of using an ornamental light display system, according to an embodiment of the present disclosure.

FIG. 5 is a flow diagram illustrating a method of using an ornamental light display system 500, according to an embodiment of the present disclosure. In particular, the method for method of using the ornamental light display system 500 may include one or more components or features of the ornamental light display system 100 as described above. As illustrated, the method of using the ornamental light display system 500 may include the steps of: step one 501, providing an ornamental light display system 100 including at least one light device 110 configured to provide periodic illumination simulating that of an insect utilizing bioluminescence, each light device 110 including a housing 112 containing a light emitting diode 114, a power supply 116 for activating and energizing the light emitting diode 114, a control circuit 118 electrically connected to the power supply 116, and a control unit 120 adapted to send control signals to the control circuit 118; step two 502, programming the control unit 120 with a preset timed interval for sending control signals to the control circuit 118; step three 503, illuminating the light emitting diode 114 according to the preset timed interval; and step four 504, controlling one or more of the light devices 110 from a remote control 130 in wireless communication with the control unit 120.

It should be noted that step four 504 is an optional step and may not be implemented in all cases. Optional steps of method of use 500 are illustrated using dotted lines in FIG. 5 so as to distinguish them from the other steps of method of use 500. It should also be noted that the steps described in the method of use can be carried out in many different orders according 152 to user preference. The use of "step of" should not be interpreted as "step for", in the claims herein and is not intended to invoke the provisions of 35 U.S.C. § 112(f). It should also be noted that, under appropriate circumstances, considering such issues as design preference, user preferences, marketing preferences, cost, structural requirements, available materials, technological advances, etc., other methods for the ornamental light display system 100 (e.g., different step orders within above-mentioned list, elimination or addition of certain steps, including or excluding certain maintenance steps, etc.), are taught herein.

The embodiments of the invention described herein are exemplary and numerous modifications, variations and rearrangements can be readily envisioned to achieve substantially equivalent results, all of which are intended to be embraced within the spirit and scope of the invention. Further, the purpose of the foregoing abstract is to enable the U.S. Patent and Trademark Office and the public generally, and especially the scientist, engineers and practitioners in the art who are not familiar with patent or legal terms or phraseology, to determine quickly from a cursory inspection the nature and essence of the technical disclosure of the application.

What is claimed is new and desired to be protected by Letters Patent is set forth in the appended claims:

1. An ornamental light display system, the ornamental light display system comprising:

at least one light device configured to provide periodic illumination simulating that of an insect utilizing bioluminescence, each light device including a housing containing a light emitting diode, a power supply for activating and energizing the light emitting diode, a control circuit electrically connected to the power supply, and a control unit adapted to send control signals to the control circuit; and a remote control in wireless commination with the control unit of each light device;

wherein the control circuit is configured to carry current to the power supply for turning the light emitting diode on or off periodically according to a preset timed interval stored on the control unit and/or one or more commands received from the remote control; and wherein the light devices are configured to operate independently of each other from their respective control units.

2. The ornamental light display system of claim 1, wherein the control unit includes a wireless communication module for receiving command signals from the remote control.

3. The ornamental light display system of claim 2, wherein at least one command from the remote control includes collectively turning the light device(s) on and alternately off.

4. The ornamental light display system of claim 1, further comprising a mounting member for securing the light device (s) on and around an external object.

5. The ornamental light display system of claim 4, wherein the mounting member includes a zip tie.

6. The ornamental light display system of claim 4, wherein the mounting member includes a strap.

7. The ornamental light display system of claim 4, wherein the mounting member is removably attached to the housing.

8. The ornamental light display system of claim 4, wherein the mounting member is permanently attached to the housing.

9. The ornamental light display system of claim 1, wherein the housing includes a channel, said channel is configured to receive a cord.

10. The ornamental light display system of claim 9, wherein the cord interconnects two or more light devices together along a length of the cord.

11. The ornamental light display system of claim 1, wherein the housing has functional-indicia embossed thereon.

12. The ornamental light display system of claim 11, wherein the functional-indicia includes the preset timed interval for the respective light device.

13. The ornamental light display system of claim 12, wherein the preset timed interval is in units of seconds.

14. The ornamental light display system of claim 1, wherein the housing includes a weathertight seal.

15. The ornamental light display system of claim 1, wherein the housing is substantially transparent.

16. The ornamental light display system of claim 1, wherein the power supply is a replaceable single cell battery.

17. An ornamental light display system comprising:

at least one light device configured to provide periodic illumination simulating that of an insect utilizing bioluminescence, each light device including a housing containing a light emitting diode, a power supply for activating and energizing the light emitting diode, a control circuit electrically connected to the power supply, and a control unit adapted to send control signals to the control circuit; and a remote control in wireless commination with the control unit of each light device;

wherein the control circuit is configured to carry current to the power supply for turning the light emitting diode on or off periodically according to a preset timed interval stored on the control unit and/or one or more commands received from the remote control;

wherein the light devices are configured to operate independently of each other from their respective control units;

wherein the control unit includes a wireless communication module for receiving command signals from the remote control;

wherein at least one command from the remote control includes collectively turning the light device(s) on and alternately off;

wherein the housing further includes a mounting member for securing the light device(s) on and around an external object;

wherein the mounting member includes a zip tie;

wherein the mounting member is removably attached to the housing;

wherein the housing includes a channel, said channel is configured to receive a cord;

wherein the cord interconnects two or more light devices together along a length of the cord;

wherein the housing has functional-indicia embossed thereon;

wherein the functional-indicia includes the preset timed interval for the respective light device;

wherein the preset timed interval is in units of seconds;

wherein the housing includes a weathertight seal;

wherein the housing is substantially transparent; and wherein the power supply is a replaceable single cell battery.

18. The ornamental light display system of claim 17, further comprising set of instructions; and wherein the ornamental light display system is arranged as a kit.

19. A method of using an ornamental light display system, the method comprising the steps of:

providing an ornamental light display system including at least one light device configured to provide periodic illumination simulating that of an insect utilizing bioluminescence, each light device including a housing containing a light emitting diode, a power supply for activating and energizing the light emitting diode, a control circuit electrically connected to the power supply, and a control unit adapted to send control signals to the control circuit, programming the control unit with a preset timed interval for sending control signals to the control circuit, and illuminating the light emitting diode according to the preset timed interval.

20. The method of claim 19, further comprising the steps of controlling one or more of the light devices from a remote control in wireless communication with the control unit.

* * * * *